US008050575B2

(12) United States Patent
Kamimura et al.

(10) Patent No.: US 8,050,575 B2
(45) Date of Patent: Nov. 1, 2011

(54) IMAGE FORMING APPARATUS AND PHOTOSENSITIVE CARTRIDGE

(75) Inventors: Naoya Kamimura, Ichinomiya (JP); Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 487 days.

(21) Appl. No.: 12/340,953

(22) Filed: Dec. 22, 2008

(65) Prior Publication Data

US 2009/0175651 A1 Jul. 9, 2009

(30) Foreign Application Priority Data

Dec. 28, 2007 (JP) ..... 2007-340757

(51) Int. Cl.
*G03G 15/00* (2006.01)

(52) U.S. Cl. ..... 399/13; 399/111; 399/113; 399/119

(58) Field of Classification Search ..... 399/13, 399/111–113, 119
See application file for complete search history.

(56) References Cited

U.S. PATENT DOCUMENTS 7,218,878 B2 * 5/2007 Okabe et al. ..... 399/113
7,526,228 B2 * 4/2009 Shiraki ..... 399/111

FOREIGN PATENT DOCUMENTS

JP 2001350307 12/2001

* cited by examiner

*Primary Examiner* — Hoang Ngo
(74) *Attorney, Agent, or Firm* — Banner & Witcoff, LTD

(57) ABSTRACT

An image forming apparatus includes a first developing cartridge and a first photosensitive cartridge. The first developing cartridge is removably mounted in the first photosensitive cartridge and includes a toner hopper, a supply roller and a developing roller. The first photosensitive cartridge includes a photosensitive drum, a charger provided at a position adjacent to the photosensitive drum, a first wall provided adjacent to the supply roller, the toner hopper, and the developing roller when the first developing cartridge is mounted in the photosensitive cartridge, the first wall including a first opening, and a second wall which faces the first wall and is provided adjacent to the charger, the second wall including a second opening on an opposite side of the charger from the photosensitive drum. A portion of a wall of the first developing cartridge projects through the first opening in the first wall of the first photosensitive cartridge.

15 Claims, 5 Drawing Sheets

IMAGE FORMING APPARATUS AND PHOTOSENSITIVE CARTRIDGE

CROSS-REFERENCE TO RELATED APPLICATIONS

This application claims priority from Japanese Patent Application No. 2007-340757 filed on Dec. 28, 2007, the entire subject matter of which is incorporated herein by reference.

TECHNICAL FIELD

Aspects of the invention relate to an image forming apparatus and a photosensitive cartridge provided in the image forming apparatus.

BACKGROUND

For example, JP-A-2001-350307 describes a related art image forming apparatus that forms an image electrophotographically, in which a plurality of photosensitive cartridges are arranged in parallel along a predetermined direction.

In each photosensitive cartridge, a cartridge frame body houses a photosensitive drum on which an electrostatic latent image is formed, a charger which charges the photosensitive drum, and a developing unit which develops the electrostatic latent image.

SUMMARY

Illustrative aspects of the invention provide a photosensitive cartridge having a reduced size and also provide an image forming apparatus having a reduced size while a plurality of photosensitive cartridges are arranged in parallel inside the image forming apparatus.

DETAILED DESCRIPTION

General Overview

Figure 1:
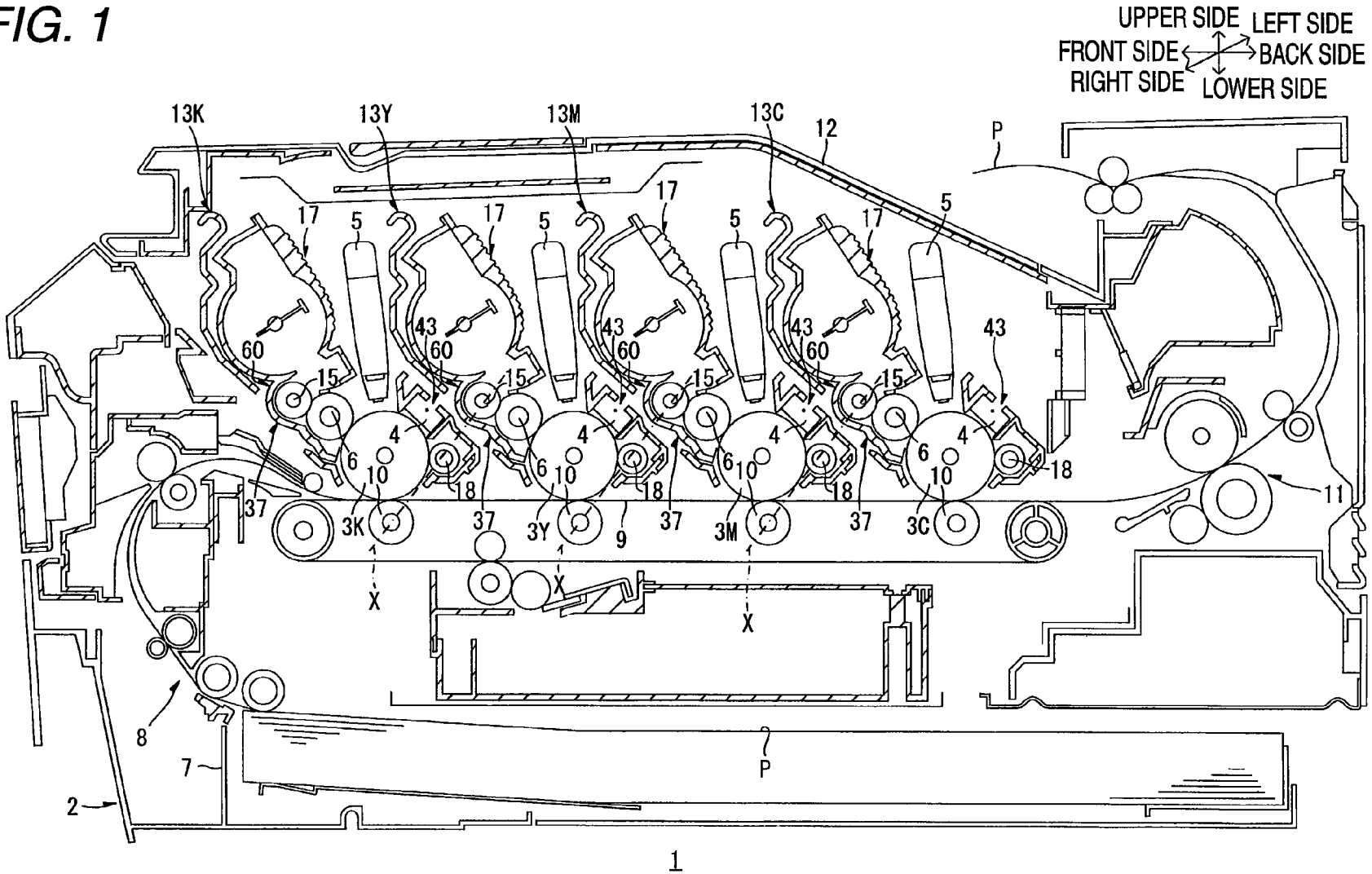
FIG. 1 is a side sectional view showing an image forming apparatus according to an exemplary embodiment of the invention.

In the related art image forming apparatus described above, a plurality of photosensitive cartridges are arranged in parallel. Thus, a size of the image forming apparatus is relatively large. Thus, it is advantageous to reduce the size of the image forming apparatus. However, for example, when the developing unit is mounted to and removed from the cartridge frame body, a space for housing the developing unit must be provided while having some spatial allowance according to the shape of the developing unit. Thus, there is a disadvantage in that it is difficult to reduce the size of the related photosensitive cartridge.

Exemplary embodiments of the present invention address the above disadvantages and other disadvantages not described above. However, the present invention is not required to overcome the disadvantages described above, and thus, an exemplary embodiment of the present invention may not overcome any of the disadvantages described above.

Accordingly, illustrative aspects of the invention provide a photosensitive cartridge having a reduced size and also provide an image forming apparatus having a reduced size while a plurality of photosensitive cartridges are arranged in parallel inside the image forming apparatus.

According to a first illustrative aspect of the invention, there is provided an image forming apparatus comprising: a first developing cartridge comprising a toner hopper, a supply roller, and a developing roller; a first photosensitive cartridge, the first developing cartridge being removably mounted in the first photosensitive cartridge, the first photosensitive cartridge comprising: a photosensitive drum on which an electrostatic latent image is formed; a charger that is provided at a position adjacent to the photosensitive drum and that charges the photosensitive drum; a first wall which is provided adjacent to the supply roller, a portion of the toner hopper, and a portion of the developing roller of the first developing cartridge when the first developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum, wherein a portion of a wall of the first developing cartridge projects through the first opening in the first wall of the first photosensitive cartridge.

According to a second illustrative aspect of the invention, there is provided an image forming apparatus comprising: a plurality of developing cartridges, each developing cartridge comprising: a toner hopper; a supply roller; a developing roller; a first arc portion forming a side wall of the toner hopper; a second arc portion forming a side wall of the supply roller and the developing roller; and a concave portion located at a position at which the first arc portion and the second arc portion meet; a plurality of photosensitive cartridges, corresponding to the developing cartridges, the developing cartridges being removably mounted in respective ones of the photosensitive cartridges, each of the photosensitive cartridges comprising: a photosensitive drum on which an electrostatic latent image is formed; a charger that is provided at a position adjacent to the photosensitive drum and that charges the photosensitive drum; a cleaning roller, which extends substantially parallel to an axial direction of the photosensitive drum and is provided adjacent to the photosensitive drum to clean the photosensitive drum; a first wall which is provided adjacent to the supply roller, a portion of the toner hopper, and a portion of the developing roller of the respective developing cartridge when the respective developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum; and a plurality of transfer rollers, corresponding to the photosensitive cartridges, each transfer roller extending substantially parallel to an axial direction of the photosensitive drum of the respective photosensitive cartridge and positioned adjacent to the photosensitive drum, wherein a portion of the second arc portion of each developing cartridge projects through the first opening in the first wall of the corresponding photosensitive cartridge, and wherein the plurality of photosensitive cartridges are arranged in parallel within the image forming apparatus such that the transfer roller and the cleaning roller of one of the photosensitive cartridges and the supply roller of a photosensitive cartridge neighboring the one of the photosensitive cartridges are arranged substantially along a straight line as viewed from an axial direction of the photosensitive drums.

According to a third illustrative aspect of the invention, there is provided a photosensitive cartridge for use with a developing cartridge which is capable of being mounted in the photosensitive cartridge and which comprises a toner hopper, a supply roller, and a developing roller, the photosensitive cartridge comprising: a photosensitive drum on which an electrostatic latent image is formed; a charger that is provided in a position adjacent to the photosensitive drum to charge the photosensitive drum; a first wall which is provided adjacent to the supply roller, a portion of the toner hopper, and a portion of the developing roller of the developing cartridge when the developing cartridge is mounted in the photosensitive cartridge, the first wall comprising an opening; and a second wall which faces a portion of the first wall and is provided adjacent to the charger.

Exemplary Embodiments

Exemplary embodiments of the invention will be described now with reference to the drawings.

(Image Forming Apparatus)

FIG. 1 is a side sectional view showing an image forming apparatus according to an exemplary embodiment of the present invention. In the specification when directions are described, the directions refer to the illustrated arrow directions of the drawings. Herein, the right-left direction and the width direction are the same.

The printer 1 is a color printer. As show in FIG. 1, in the printer 1, inside a body casing 2, as an example of an image forming apparatus body, four photosensitive drums 3 are arranged in parallel along the front-back direction. Hereinafter, the four photosensitive drums 3 are distinguished by color (black, yellow, magenta, or cyan) of a developer image (described later) formed on each photosensitive drum 3. The four photosensitive drums 3 comprise a photosensitive drum 3K (black), a photosensitive drum 3Y (yellow), a photosensitive drum 3M (magenta), and a photosensitive drum 3C (cyan). In each photosensitive drum 3, for example, a scorotron-type charger 4, a light emitting diode (LED) unit 5, a developing roller 6, and a cleaning roller 18 are arranged and opposed to each other.

The surfaces of the photosensitive drums 3 are evenly charged by the chargers 4 and then exposed by LEDs (not shown) provided in the LED units 5. Accordingly, on the surfaces of the respective photosensitive drums 3, electrostatic latent images based on image data are formed. The electrostatic latent images are visualized by developer carried on the developing rollers 6 corresponding to the respective photosensitive drums 3, and developer images are formed on the surfaces of the photosensitive drums 3.

Sheets P (e.g., transfer media) are housed in a sheet feeding cassette 7 inside the body casing 2. After a sheet P is picked up from the sheet feeding cassette 7, a direction of the sheet P is changed from a front direction to a back direction, and the sheet P is fed to the conveyor belt 9 by various rollers provided in a feeder unit 8. The conveyor belt 9 is arranged and opposed to the corresponding photosensitive drums 3 from below. The conveyor belt 9 is arranged between the photosensitive drums 3K, 3Y, 3M, and 3C and four transfer rollers 10 provided corresponding to the four photosensitive drums 3. Developer images on the surfaces of the photosensitive drums 3 are transferred onto the sheet P conveyed by the conveyor belt 9 by a transfer bias applied to the transfer rollers 10, and sequentially superimposed.

The sheet P on which a developer image in four colors was transferred is conveyed to a fixing part 11. The developer image transferred onto the sheet P is heat-fixed on the fixing part 11. Thereafter, a conveying direction of the sheet P is changed from the back direction to the front direction, and the sheet P is discharged to a discharge tray 12 by various rollers.

In such an image forming, a cleaning bias for collecting developer is applied to the cleaning rollers 18. Accordingly, remaining developer remaining on the photosensitive drums 3 after transferring developer images onto the conveyor belt 9 (i.e., onto the sheet P) is temporarily collected by the cleaning roller 18. Then, when finishing image-forming, a bias reverse to the cleaning bias is applied to the cleaning rollers 18, so that the developer collected by the cleaning rollers 18 is discharged to the photosensitive drums 3 from the cleaning rollers 18 and then recovered by the developing roller 6. Accordingly, the photosensitive drums 3 are cleaned by the cleaning rollers 18.

(Photosensitive Cartridge)

Figure 2:
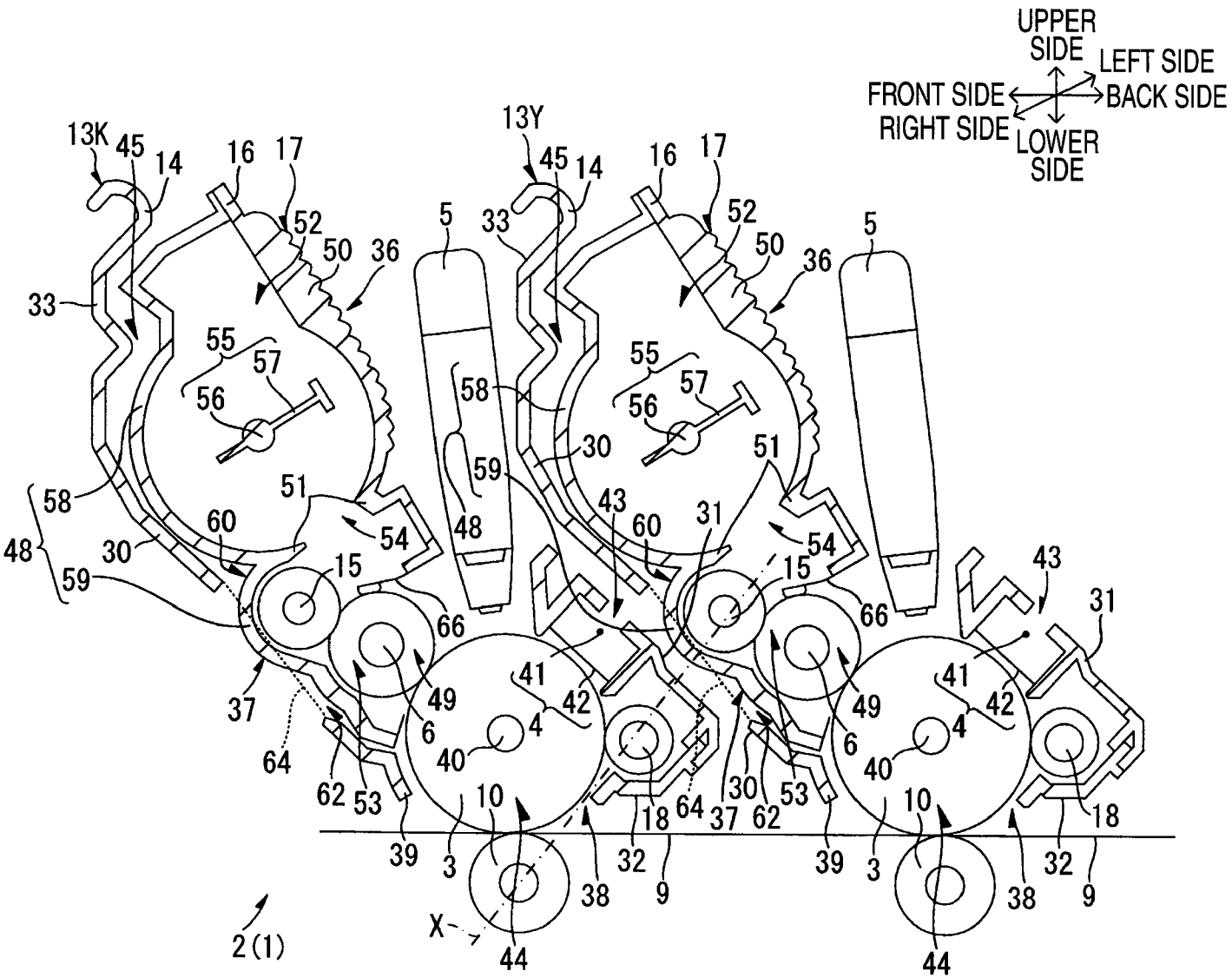
FIG. 2 is an enlarged view of two adjacent photosensitive cartridges of the image forming apparatus of FIG. 1.
Figure 3:
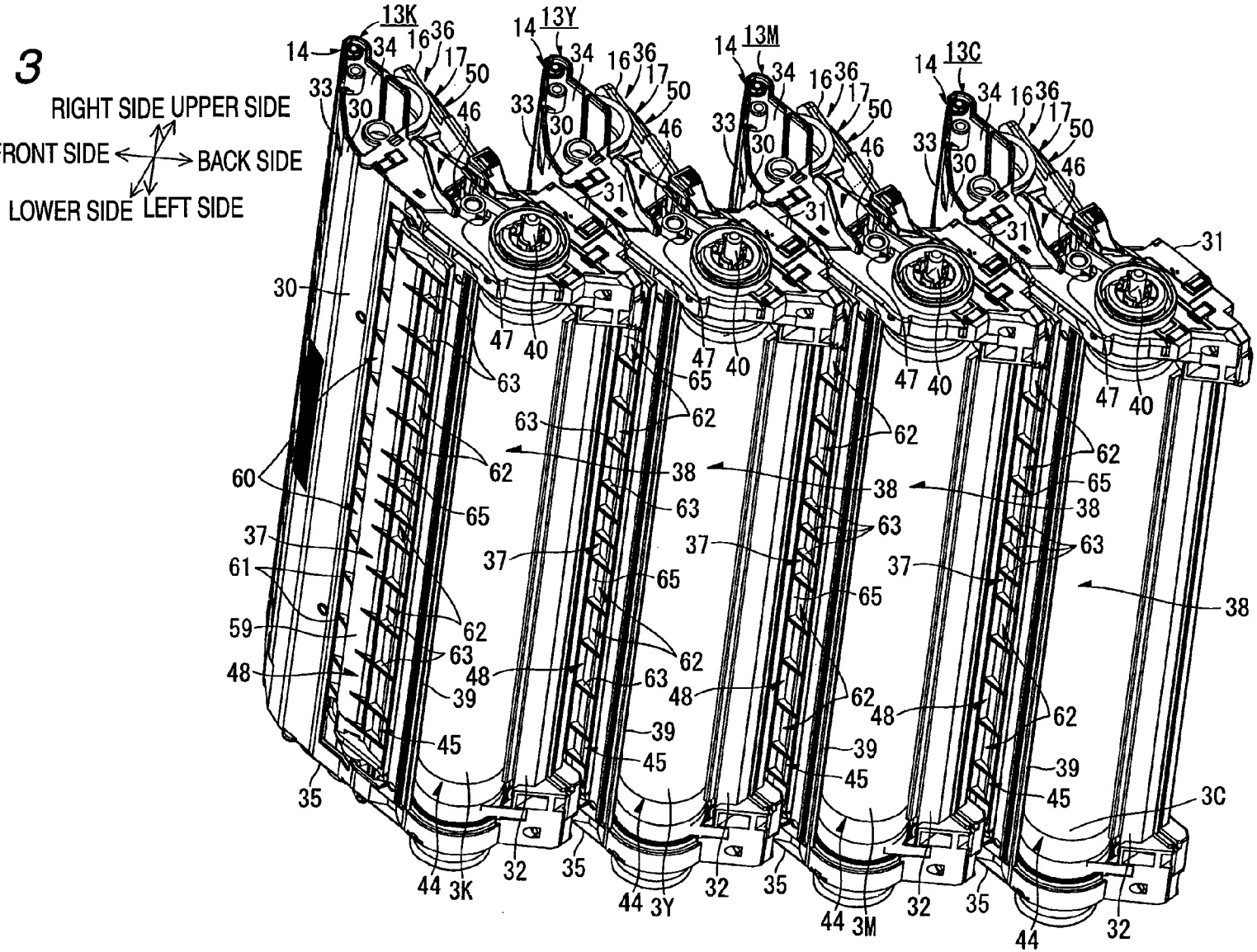
FIG. 3 is a perspective view from the lower right side showing four photosensitive cartridges arranged in parallel in a body casing of the image forming apparatus of FIG. 1.
Figure 4:
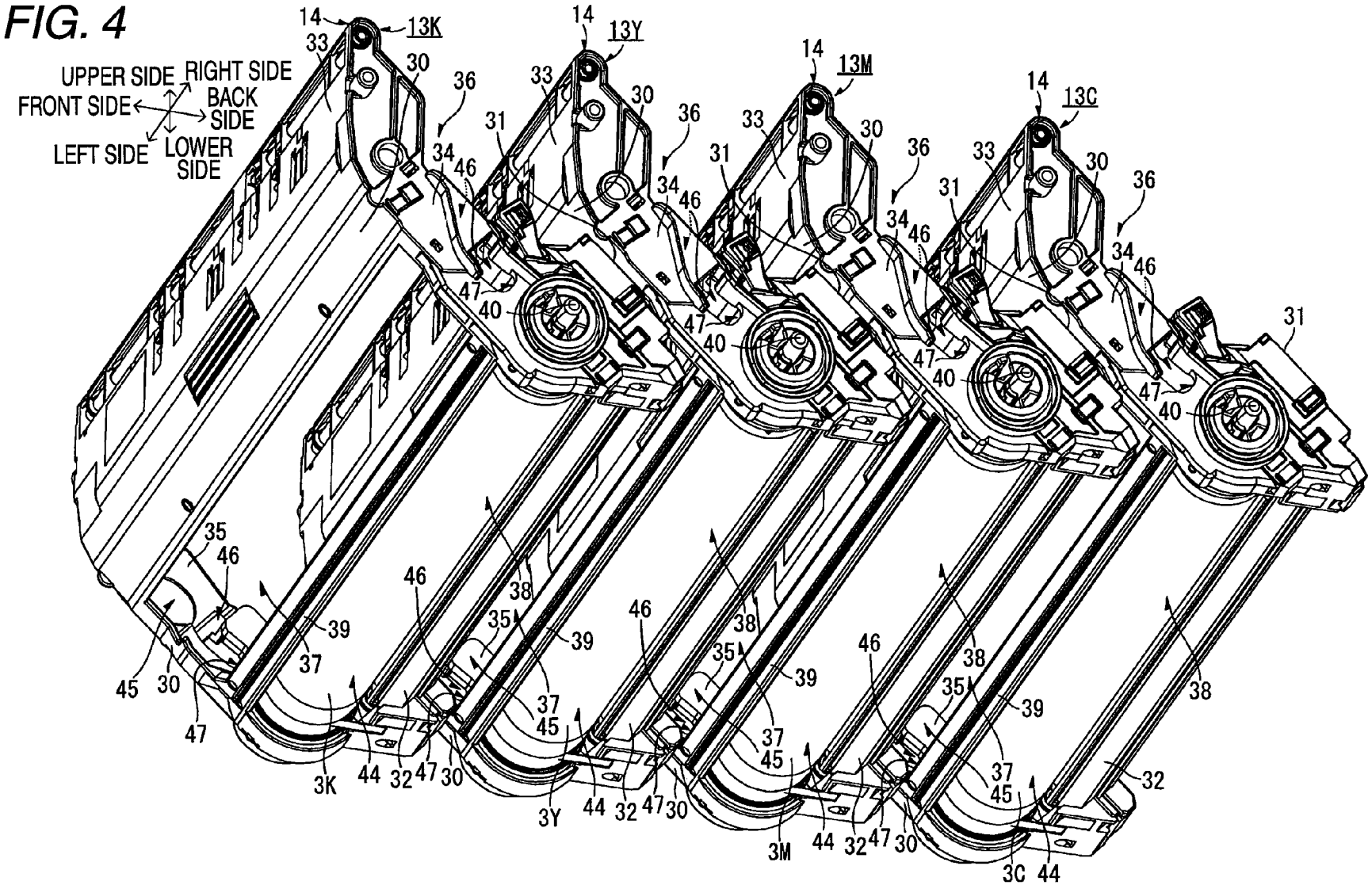
FIG. 4 is a view of the photosensitive cartridges of FIG. 3, showing a state in which four developing cartridges are removed respectively from the four photosensitive cartridges.

FIG. 2 is an enlarged view of two adjacent photosensitive cartridges that have been extracted from the image forming apparatus of FIG. 1. FIG. 3 is a perspective view viewed from the lower right side of the four photosensitive cartridges of the image forming apparatus of FIG. 1 arranged in parallel in the body casing. FIG. 4 shows a state of the four photosensitive cartridges in which the developing cartridges are removed from the photosensitive cartridges of FIG. 3. The perspective direction is slightly changed between FIG. 3 and FIG. 4.

The printer 1 includes four photosensitive cartridges 13 corresponding to the respective colors. Hereinafter, four photosensitive cartridges 13 are distinguished as a photosensitive cartridge 13K (black), a photosensitive cartridge 13Y (yellow), a photosensitive cartridge 13M (magenta), and a photosensitive cartridge 13C (cyan) corresponding to the colors.

The photosensitive cartridges 13, inside the body casing 2, are arranged in parallel along the front-back direction. In detail, the photosensitive cartridges 13 are arranged, for example, in order of, from the front side, the photosensitive cartridge 13K, the photosensitive cartridge 13Y, the photosensitive cartridge 13M, and the photosensitive cartridge 13C.

The photosensitive cartridges 13 can be mounted to and removed from the body casing 2. When removing the photosensitive cartridges 13, the inside of the body casing 2 is opened upward by shifting the discharge tray 12 positioned above the photosensitive cartridges 13 (see FIG. 1), and the photosensitive cartridges 13 are raised from the inside of the body casing 2. Conversely, when mounting the photosensitive cartridges 13, the inside of the body casing 2 is opened at the top by shifting the discharge tray 12, and the photosensitive cartridges 13 are lowered to the inside of the body casing 2. The photosensitive cartridges 13 may be mounted and removed integrally, or may be individually mounted and removed.

As shown in FIG. 2, the photosensitive cartridge 13 includes a photosensitive casing 14 as an example of a housing. The photosensitive casing 14 has a box shape long in the width direction. In the state in which the photosensitive cartridge 13 is mounted to the body casing 2, the photosensitive casing 14 is inclined diagonally to the upper front side (see FIG. 1, as well).

The photosensitive casing 14 includes a first wall 30, a second wall 31, a third wall 32, a fourth wall 33, a fifth wall 34, and a sixth wall 35 integrally (the fifth wall 34 and the sixth wall 35 are depicted in FIG. 3 and FIG. 4). The first wall 30, the second wall 31, the third wall 32, the fourth wall 33, the fifth wall 34, and the sixth wall 35 form the outer wall of the photosensitive casing 14.

The first wall 30 has a plate shape and is longer in the width direction, and inclined diagonally to the upper front side.

The second wall 31 has a plate shape and is longer in the width direction, and inclined diagonally to the upper front side. The second wall 31 is opposed to the first wall 30 (in detail, the lower portion of the first wall 30) leaving a space therebetween, and extends parallel to the first wall 30.

The third wall 32 has a plate shape and is longer in the width direction, and extends substantially horizontally backward continuously from the lower end of the first wall 30. The back end of the third wall 32 is slightly bent diagonally to the upper back side, and continued to the lower end of the second wall 31.

The fourth wall 33 has a plate shape and is longer in the width direction, and extends substantially vertically upward continuously from the upper end of the first wall 30.

As shown in FIG. 3, the fifth wall 34 has a substantially rectangular plate shape when viewed in the width direction. The fifth wall 34 is connected to the right ends of the first wall 30, the second wall 31, the third wall 32, and the fourth wall 33. In the left side surface of the fifth wall 34, a guide groove 46 is formed. The guide groove 46 extends downward while slightly curving from the substantially central portion in the up-down direction of the edge on the upper back side of the fifth wall 34. A lower end portion (referred to as an end point 47) of the fifth wall 34 is formed into an opening penetrating through the fifth wall 34, and is exposed to the right side from the fifth wall 34.

The sixth wall 35 has substantially the same shape as that of the fifth wall 34, and is connected to the left ends of the first wall 30, the second wall 31, the third wall 32, and the fourth wall 33. In the right side surface of the sixth wall 34, a guide groove 46 is formed in the same manner as the fifth wall 34 (see FIG. 4).

In the photosensitive casing 14, as shown in FIG. 4, a first opening 36 is formed. In the photosensitive casing 14 a second opening 37, as an example of an opening, and a third opening 38, as an example of an exposure opening are also formed.

The first opening 36 is a substantially rectangular opening, and is sectioned by the upper ends of the second wall 31, the fourth wall 33, the fifth wall 34, and the sixth wall 35 in the photosensitive casing 14 (see also FIG. 2).

The second opening 37 is a substantially rectangular opening, and is formed across substantially the entire lower region of the first wall 30.

The third opening 38 is a substantially rectangular opening, and is formed across substantially the entire front region of the third wall 32.

Herein, the lower portion from the second opening 37 on the first wall 30 and the front portion from the third opening 38 on the third wall 32 are referred to as a rib 39. The rib 39 extends in the width direction between the second opening 37 and the third opening 38, and is formed across the fifth wall 34 and the sixth wall 35.

As shown in FIG. 2, in the photosensitive casing 14, a corresponding photosensitive drum 3, a charger 4, a developing roller 6, a supply roller 15, a toner hopper 16 accommodating developer, and a cleaning roller 18 are arranged. The central axes (i.e., the rotation axes) of the photosensitive drum 3, the developing roller 6, the supply roller 15, and the cleaning roller 18 extend along the width direction. In the photosensitive cartridge 13, developer accommodated in a toner hopper 16 is supplied to the developing roller 6 by the supply roller 15, and carried on the developing roller 6 as described above.

The developing roller 6, the supply roller 15, and the toner hopper 16 are formed as a unit, and can be mounted to and removed from the photosensitive casing 14 as a developing cartridge 17. The developing cartridge 17 is mounted to and removed from the body casing 2 in a state in which the developing cartridge 17 is mounted to the photosensitive casing 14 (that is, as a part of the photosensitive cartridge 13). The developing cartridge 17 can be mounted to and removed from the body casing 2 while the photosensitive casing 14 is mounted to the body casing 2. The developing cartridge 17 will be described in detail later. The photosensitive cartridge 13 and the developing cartridge 17 configure a process cartridge.

The photosensitive casing 14 includes a drum shaft 40. The drum shaft 40 extends along the width direction of the photosensitive casing 14. The right end of the drum shaft 40 is supported on the lower portion of the fifth wall 34, and the left end of the drum shaft 40 is supported on the lower portion of the sixth wall 35 (see FIG. 3 and FIG. 4). The drum shaft 40 is inserted through the circular central portion of the photosensitive drum 3, and the photosensitive drum 3 is supported on the photosensitive casing 14 via the drum shaft 40 inside the photosensitive casing 14 (i.e., in the space surrounded by the second wall 31, the third wall 32, the fifth wall 34, and the sixth wall 35), and can rotate around the drum shaft 40. The lower portion of the surface (outer peripheral surface) of the photosensitive drum 3 is exposed to the lower side (transfer roller 10 side) from the third opening 38 (see FIG. 4).

The charger 4 is sandwiched in the width direction by the fifth wall 34 and the sixth wall 35 (see FIG. 3) so as to be adjacent to the second wall 31 at the diagonally upper back side of the photosensitive drum 3, and is arranged and opposed to the photosensitive drum 3 leaving a space therebetween so as not to come into contact with the photosensitive drum 3. In detail, the charger 4 includes a discharge wire 41 arranged and opposed to the photosensitive drum 3 leaving a space therebetween, and a grid 42 which is provided between the discharge wire 41 and the photosensitive drum 3 and controls the charge amount into the photosensitive drum 3 from the discharge wire 41. When a bias voltage is applied to the grid 42, a high voltage is applied to the discharge wire 41 to corona-discharge the discharge wire 41, whereby the surface of the photosensitive drum 3 is evenly charged. The charger 4 is provided with a wire cleaner (not shown) which sandwiches the discharge wire 41, and the wire cleaner cleans the discharge wire 41 by sliding in the width direction. Herein, in the second wall 31, a fourth opening 43 is formed. The fourth opening 43 is an opening long in the width direction, and the charger 4 is exposed to the diagonally upper back side via the fourth opening 43.

The cleaning roller 18 is arranged and opposed to the photosensitive drum 3 from the back side so as to come into contact with the surface of the photosensitive drum 3. The cleaning roller 18 has a right end portion rotatably supported on the fifth wall 34, and a left end portion rotatably supported on the sixth wall 35.

The internal space of the photosensitive casing 14 is sectioned into a first space 44 in which the photosensitive drum 3, the charger 4, and the cleaning roller 18 are arranged, and a second space 45. The second space 45 is continued from the first space 44 and positioned at a diagonally upper front side of the first space 44. The second space 45 communicates with the first opening 36 at the upper back side, and communicates with the second opening 37 at the lower front side. In the second space 45, a developing cartridge 17 is arranged. At a boundary portion between the first space 44 and the second space 45 outside of the photosensitive cartridge 13 (i.e., a portion corresponding to a vicinity of the lower end of the first opening 36), the lower end portion (portion which emits light and exposes the photosensitive drum 3) of the LED unit 5 is arranged.

In the state in which the four photosensitive cartridges 13 are arranged in parallel along the front-back direction inside the body casing 2 (see FIG. 1), as shown in FIG. 2 through FIG. 4, the first wall 30 of the second photosensitive cartridge 13 (for example, the photosensitive cartridge 13Y) is opposed to the second wall 31 of the first photosensitive cartridge 13 (for example, the photosensitive cartridge 13K) arranged adjacent to the front side of the second photosensitive cartridge 13 while leaving a slight space therebetween. In this state, as shown in FIG. 2, the second opening 37 of the first wall 30 of the second photosensitive cartridge 13 is opposed to the fourth opening 43 of the second wall 31 of the first photosensitive cartridge 13.

In other words, as shown in FIG. 1, the second opening 37 of the photosensitive cartridge 13C is opposed to the fourth opening 43 of the photosensitive cartridge 13M. Likewise, the second opening 37 of the photosensitive cartridge 13M is opposed to the fourth opening 43 of the photosensitive cartridge 13Y. The second opening 37 of the photosensitive cartridge 13Y is opposed to the fourth opening 43 of the photosensitive cartridge 13K.

Herein, the above-described four transfer rollers 10 extend substantially parallel to the axial directions (width directions) of the supply rollers 15. The cleaning rollers 18 also extend substantially parallel to the axial directions of the supply rollers 15. As shown in FIG. 2, the transfer roller 10 (i.e., the central axis of the transfer roller 10) corresponding to (opposed to) the photosensitive drum 3 of the first photosensitive cartridge 13 (e.g., photosensitive cartridge 13K), the cleaning roller 18 (i.e., the central axis of the cleaning roller 18) of the first photosensitive cartridge 13 (e.g., photosensitive cartridge 13K), and the supply roller 15 (i.e., the central axis of the supply roller 15) of the second photosensitive cartridge 13 (e.g., photosensitive cartridge 13Y) arranged adjacent to the back side of the first photosensitive cartridge 13 (e.g., photosensitive cartridge 13K) are arranged substantially on the same straight line X when they are projected in the width direction.

In other words, as shown in FIG. 1, the central axis of the transfer roller 10 opposed to the photosensitive drum 3K of the photosensitive cartridge 13K, the central axis of the cleaning roller 18 of the photosensitive cartridge 13K, and the central axis of the supply roller 15 of the photosensitive cartridge 13Y are arranged substantially on the same straight line X when they are projected in the width direction. Likewise, the central axis of the transfer roller 10 opposed to the photosensitive drum 3Y of the photosensitive cartridge 13Y, the central axis of the cleaning roller 18 of the photosensitive cartridge 13Y, and the central axis of the supply roller 15 of the photosensitive cartridge 13M are arranged substantially on the same straight line X when they are projected in the width direction. The central axis of the transfer roller 10 opposed to the photosensitive drum 3M of the photosensitive cartridge 13M, the central axis of the cleaning roller 18 of the photosensitive cartridge 13M, and the central axis of the supply roller 15 of the photosensitive cartridge 13C are arranged substantially on the same straight line X when they are projected in the width direction.

(Developing Cartridge)

Figure 5:
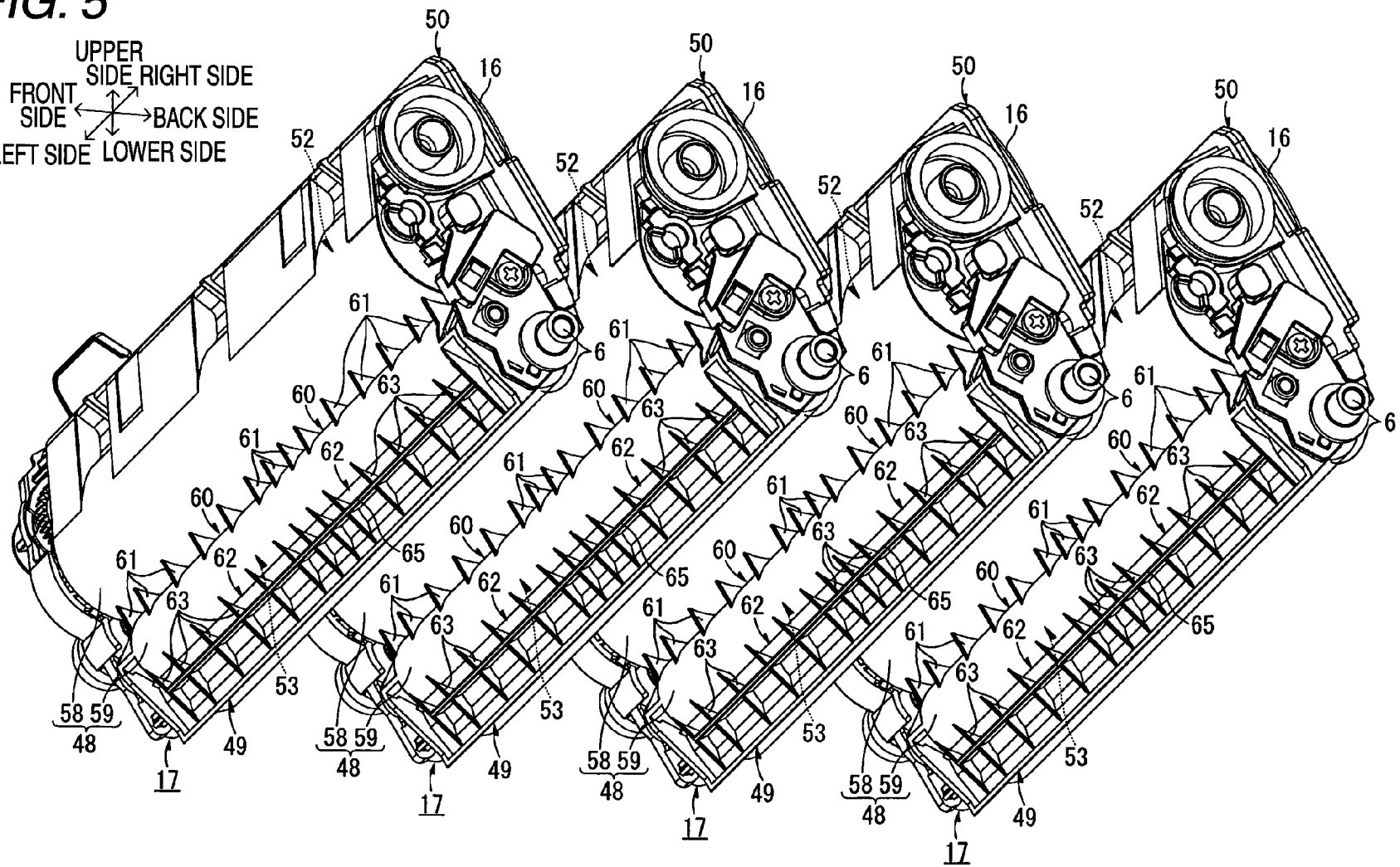
FIG. 5 is a view of the four developing cartridges from the four photosensitive cartridges in FIG. 3.

FIG. 5 shows four developing cartridges extracted from the photosensitive cartridges of FIG. 3. Note that the perspective direction is slightly different between FIG. 3 and FIG. 5.

As shown in FIG. 2, the developing cartridge 17 includes a developing casing 50. The developing casing 50 has a box shape and is longer in the width direction (see FIG. 5). The size of the developing casing 50 is such that the developing casing 50 may be housed in the second space 45 of the photosensitive casing 14.

In a state in which the photosensitive cartridge 13 is mounted to the body casing 2 and the developing cartridge 17 is mounted to the photosensitive casing 14 (see FIG. 1), the developing casing 50 inclines diagonally to the upper front side similarly to the photosensitive casing 14. In the developing casing 50, a side wall opposed to the first wall 30 of the photosensitive casing 14 is referred to as a developing side wall 48. At the lower side of the developing casing 50, a lower opening 49 is formed, and the lower opening 49 communicates with the inside of the developing casing 50.

In the middle in the up-down direction of the inside of the developing casing 50, a partition 51 extending in the width direction is provided. The partition 51 sections the inside of the developing casing 50 into a first region 52 and a second region 53. The first region 52 is at the upper side of the second region 53. In the partition 51, a communicating hole 54 is formed, and the first region 52 and the second region 53 communicate with each other via the communicating hole 54.

The first region 52 corresponds to the inside of the toner hopper 16 and accommodates developer. Inside the first region 52, an agitator 55 is arranged. The agitator 55 includes a shaft 56 extending along the width direction and a blade 57 attached to this shaft 56. When the blade 57 of the agitator 55 rotates around the shaft 56 as a center, the developer in the first region 52 is agitated by the blade 57 and discharged from the communicating hole 54 to the second region 53. The first region 52 is sectioned in a substantially circular shape in the width direction so as to allow rotation of the blade 57. The portion corresponding to the first region 52 on the developing side wall 48 has an arc shape swelling diagonally to the lower front side when viewed in the width direction, and is referred to as a first arc portion 58.

The second region 53 houses the developing roller 6 and the supply roller 15. The supply roller 15 is arranged adjacent to the lower side of the communicating hole 54. The developing roller 6 is arranged on the back (i.e., on the diagonally lower back side) of the supply roller 15. In the developing roller 6, the outer peripheral surface on the diagonally upper front side is in pressure contact with the outer peripheral surface of the supply roller 15, and between the developing roller 6 and the supply roller 15, a nip is formed. The outer peripheral surface on the back side of the developing roller 6 is exposed from the lower opening 49 of the developing casing 50. On the right side wall of the developing casing 50, the right end portion of the developing roller 6 (i.e., the axis of the developing roller 6) is exposed (see FIG. 5). On the left side wall of the developing casing 50, the left end portion of the developing roller 6 (i.e., the axis of the developing roller 6) is exposed although the exposed axis is not shown. To the upper end of the lower opening 49 in the developing casing 50, a base end portion of a layer thickness restricting blade 66 is attached. At the free end portion of the layer thickness restricting blade 66, a pressure contact rubber is provided, and the pressure contact rubber presses the surface of the developing roller 6.

In a state in which the developing cartridge 17 is mounted to the photosensitive casing 14, the portion of the developing roller 6 exposed from the lower opening 49 of the developing casing 50 is in contact with the photosensitive drum 3. Developer discharged from the communicating hole 54 to the second region 53 is supplied to the developing roller 6 via the above-described nip from the supply roller 15. The developer supplied to the developing roller 6 enters between the pressure contact rubber of the layer thickness restricting blade 66 and the surface of the developing roller 6 and becomes a thin layer with a constant thickness, and carried on the surface of the developing roller 6. Developer carried on the developing roller 6 visualizes the electrostatic latent image on the photosensitive drum 3 as described above.

The portion of the developing side wall 48 corresponding to the supply roller 15 has an arc shape swelling substantially forward in the width direction corresponding to the shape of the supply roller 15, and is referred to as a second arc portion 59. The second arc portion 59 is below and is continuous with the first arc portion 58. On the developing side wall 48, at the boundary between the first arc portion 58 and the second arc portion 59, a first concave portion 60, as an example of a concave portion, which is concaved in a substantially V shape diagonally to the upper back side, is formed. At the deepest portion of the first concave portion 60, the base end of the partition 51 is positioned. Therefore, the first concave portion 60 forms the boundary between the first region 52 and the second region 53.

As shown in FIG. 5, the first concave portion 60 is formed across the entire region in the width direction of the developing side wall 48. In the first concave portion 60, a plurality of first ribs 61 are provided at intervals in the width direction. The first ribs 61 have substantially triangular thin-plate shapes having a size capable of blocking the first concave portion 60 viewed from the width direction. The first ribs 61 connect the first arc portion 58 and the second arc portion 59. Accordingly, strength of the developing side wall 48 in the first concave portion 60 is secured.

As shown in FIG. 2, on the lower portion from the second arc portion 59 on the developing side wall 48 (i.e., a portion corresponding to the lower end of the lower opening 49 and the developing roller 6), a second concave portion 62 concaved diagonally to the upper back side in a substantially trapezoid shape is formed. The second concave portion 62 is shallower than the first concave portion 60. As shown in FIG. 5, the second concave portion 62 is formed across the entire region in the width direction of the developing side wall 48. In the second concave portion 62, a plurality of second ribs 63 are provided at intervals in the width direction. The second ribs 63 have substantially trapezoid thin-plate shapes having a size capable of blocking the second concave portion 62 viewed from the width direction. The second ribs 63 connect the second arc portion 59 and the lower portion from the second arc portion 59 on the developing side wall 48. Accordingly, a strength of the developing side wall 48 in the second concave portion 62 is increased. In the second concave portion 62, a third rib 65 is provided. The third rib 65 extends along the width direction and partitions the third concave portion 62 into upper and lower portions.

(Mounting of Developing Cartridge to Photosensitive Casing)

When mounting the developing cartridge 17 with respect to the photosensitive casing 14, first, the photosensitive casing 14 is placed on a horizontal plane so that the first opening 36 (see FIG. 2) turns upward and is in a horizontal state. The developing cartridge 17 is lowered diagonally from above, and is pushed into the second space 45 from the first opening 36 of the photosensitive casing 14 (see FIG. 2 and FIG. 4). At this time, the right end portion of the developing roller 6 is received in the guide groove 46 (see FIG. 4) of the fifth wall 34 of the photosensitive casing 14 and advances inside the guide groove 46. Likewise, the left end portion of the developing roller 6 is received in the guide groove 46 (see FIG. 4) of the sixth wall 35 of the photosensitive casing 14 and advances inside the guide groove 46. Thereafter, as shown in FIG. 3, the developing cartridge 17 is pushed into the second space 45 until the right end portion and left end portion of the developing roller 6 reach the endpoints 47 of the corresponding guide grooves 46, and the developing cartridge 17 is housed in the second space 45, whereby mounting of the developing cartridge 17 to the photosensitive casing 14 is completed.

In the mounted state, as shown in FIG. 2 and as described above, the portion of the developing roller 6 exposed from the lower opening 49 comes into contact with the photosensitive drum 3, and the developing side wall 48 (i.e., ribs not shown but projecting from the first arc portion 58) is in contact with the first wall 30 (i.e., a roller not shown provided on the first wall 30) of the photosensitive casing 14. Accordingly, the developing cartridge 17 is positioned in the photosensitive casing 14 (in detail, the second space 45). In each photosensitive cartridge 13 in which mounting of the developing cartridge 17 to the photosensitive casing 14 is completed, on the developing side wall 48, the second arc portion 59, the first concave portion 60, the first ribs 61, the second concave portion 62, and the second ribs 63 face the second opening 37 of the first wall 30, and are exposed to the outside (diagonally lower front side in FIG. 2) from the second opening 37 (see also FIG. 3). In particular, using the state of FIG. 2 as a reference, the second arc portion 59 projects diagonally to the lower front side from the second opening 37. Herein, projection of the second arc portion 59 from the second opening 37 denotes that the second arc portion 59 projects to the outside of the photosensitive casing 14 (diagonally lower front side) more than the inner surface 64 of the first wall 30 in the second opening 37 (i.e., the surface of the first wall 30 which faces the inside of the photosensitive casing 14, indicated by the dotted line). In each of the photosensitive cartridge 13K, the photosensitive cartridge 13Y, the photosensitive cartridge 13M, and the photosensitive cartridge 13C (see FIG. 1 and FIG. 3), the second arc portion 59 projects to the outside of the photosensitive casing 14 from the second opening 37.

Thus, the developing cartridge 17 mounted to the photosensitive casing 14 is arranged in (i.e., mounted in) the second space 45 of the photosensitive casing 14 so that the second arc portion 59 projects from the second opening 37.

When the four developing cartridges 17 are mounted to the corresponding photosensitive casings 14, the developing cartridges 17 are arranged in parallel along the front-back direction inside the body casing 2 in the same manner as the four photosensitive cartridges 13 (see FIG. 1, FIG. 3, and FIG. 5).

In the mounted state, as described above, the second opening 37 of the first wall 30 of the second photosensitive cartridge 13 is opposed to the fourth opening 43 of the second wall 31 of the first photosensitive cartridge 13 (e.g., the photosensitive cartridge 13K) arranged adjacent to the front side of the second photosensitive cartridge 13 (e.g., the photosensitive cartridge 13Y). In each photosensitive cartridge 13, as described above, the first concave portion 60 and the second concave portion 62 of the second photosensitive cartridge 13 (e.g., photosensitive cartridge 13Y) face the second opening 37 of the first wall 30 of the second photosensitive cartridge 13 (e.g., photosensitive cartridge 13Y), and is exposed diagonally to the lower front side from this second opening 37. The first concave portion 60 exposed from the second opening 37 in the second photosensitive cartridge 13 (e.g., photosensitive cartridge 13Y) is opposed to the charger 4 exposed diagonally to the upper back side from the fourth opening 43 in the first photosensitive cartridge 13 (e.g., photosensitive cartridge 13K) via the second opening 37.

In other words, as shown in FIG. 1, the first concave portion 60 of the photosensitive cartridge 13Y is opposed to the charger 4 of the photosensitive cartridge 13K. Likewise, the first concave portion 60 of the photosensitive cartridge 13M is opposed to the charger 4 of the photosensitive cartridge 13Y. The first concave portion 60 of the photosensitive cartridge 13C is opposed to the charger 4 of the photosensitive cartridge 13M.

As shown in FIG. 2, the second concave portion 62 exposed from the second opening 37 in the second photosensitive cartridge 13 (e.g., photosensitive cartridge 13Y) is not opposed to the charger 4 of the first photosensitive cartridge 13 (e.g., photosensitive cartridge 13K), however, it is arranged close to the charger 4.

As described above, in the photosensitive casing 14 of the photosensitive cartridge 13, the charger 4 is arranged adjacent to the second wall 31, and to the photosensitive casing 14, the developing cartridge 17 is mounted so as to project from the second opening 37 of the first wall 30 opposed to the second wall 31. Therefore, in the photosensitive casing 14, the charger 4 and the second wall 31 can be made closer to the first wall 30 to an extent of the projection of the developing cartridge 17 from the second opening 37 of the first wall 30.

As a result, the size of the photosensitive cartridge 13 can be reduced. Further, the size of the printer 1 (see FIG. 1), in which a plurality of photosensitive cartridges 13 are arranged in parallel along the front-back direction inside the body casing 2, can be reduced. In at least one photosensitive cartridge 13, the developing cartridge 17 is arranged so as to project from the second opening 37, and thus the size of the printer 1 may be reduced. However, if, in all photosensitive cartridges 13, the developing cartridges 17 are arranged so as to project from the second openings 37, the size of the printer 1 can be reduced even more.

In the first photosensitive cartridge 13 (e.g., the photosensitive cartridge 13K), the developing cartridge 17 is provided with a first region 52 accommodating developer, a second region 53 housing the developing roller 6 and the supply roller 15, and the first concave portion 60 which forms the boundary between the first region 52 and the second region 53 and faces the second opening 37. In the second photosensitive cartridge 13 (e.g., the photosensitive cartridge 13Y), the first concave portion 60 is opposed to the charger 4 of the first photosensitive cartridge 13 (e.g., the photosensitive cartridge 13K) arranged adjacent to the front side of the second photosensitive cartridge 13 (e.g., the photosensitive cartridge 13Y) via the second opening 37. Normally, the charger 4 charges the surface of the photosensitive drum 3 by blowing ion wind containing ions with respect to the photosensitive drum 3, so that air to be blown must be supplied to the charger 4. Herein, from the space formed in the first concave portion 60 of the second photosensitive cartridge 13 (e.g., the photosensitive cartridge 13Y), air is supplied to the charger 4 of the first photosensitive cartridge 13 (e.g., the photosensitive cartridge 13K), so that the photosensitive drum 3 of the first photosensitive cartridge 13 (e.g., the photosensitive cartridge 13K) can be efficiently charged.

As described above, the second concave portion 62 exposed from the second opening 37 in the second photosensitive cartridge 13 (e.g., the photosensitive cartridge 13Y) is not opposed to the charger 4 of the first photosensitive cartridge 13 (e.g., the photosensitive cartridge 13K). However, the second concave portion 62 is arranged close to the charger 4. Therefore, from the space formed in the second concave portion 62 of the second photosensitive cartridge 13 (e.g., the photosensitive cartridge 13Y), air can also be supplied to the charger 4 of the first photosensitive cartridge 13 (e.g., the photosensitive cartridge 13K), so that the photosensitive drum 3 of the first photosensitive cartridge 13 (e.g., the photosensitive cartridge 13K) can be more efficiently charged.

Behind the charger 4 of the photosensitive cartridge 13C (see FIG. 1) at the backmost position, a sufficient space for taking air into the charger 4 is secured.

In the printer 1, the transfer roller 10 corresponding to the first photosensitive cartridge 13 (e.g., the photosensitive cartridge 13K), the cleaning roller 18 of the first photosensitive cartridge 13 (e.g., the photosensitive cartridge 13K), and the supply roller 15 of the second photosensitive cartridge 13 (e.g., the photosensitive cartridge 13Y) arranged adjacent to the back side of the first photosensitive cartridge 13 (e.g., the photosensitive cartridge 13K) are arranged on substantially the same straight line X when they are projected in the width direction (see FIG. 1, as well). Accordingly, the distance between the photosensitive drum 3 of the first photosensitive cartridge 13 (e.g., the photosensitive cartridge 13K) and the photosensitive drum 3 of the second photosensitive cartridge 13 (e.g., the photosensitive cartridge 13Y) arranged adjacent to the back side of the first photosensitive cartridge 13 (e.g., the photosensitive cartridge 13K) can be made shortest, so that the first photosensitive cartridge 13 (e.g., the photosensitive cartridge 13K) and the second photosensitive cartridge 13 (e.g., the photosensitive cartridge 13Y) can be made more adjacent to each other. Accordingly, the plurality of photosensitive cartridges 13 arranged in parallel can be more tightly together as a whole, so that the size of the printer 1 can be reduced.

In the photosensitive casing 14, ribs 39 are provided between the third opening 38 for exposing the photosensitive drum 3 to the transfer roller 10 side and the second opening 37, so that strength of the photosensitive casing 14 between the third opening 38 and the second opening 37 can be increased (see FIG. 4).

The photosensitive cartridges 13 can be mounted to and removed from the body casing 2, so that maintenance of the photosensitive cartridges 13 becomes possible. Accordingly, usability can be improved.

Modified Exemplary Embodiments

In the above-described exemplary embodiments, a so-called direct transfer type color printer in which developer images on the surfaces of the photosensitive drums 3 are directly transferred onto a sheet P was illustrated. However, for example, the present inventive concept is also applicable to intermediate transfer type color printers in which developer images on the photosensitive drums 3 are temporarily transferred onto an intermediate transfer member and then collectively transferred onto a sheet P, and to monochrome printers.

As described above, the photosensitive drums 3 are exposed by LEDs. However, the present invention is also applicable to laser printers which expose the photosensitive drums 3 by laser.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a first developing cartridge comprising a toner hopper, a supply roller, and a developing roller;

a first photosensitive cartridge, the first developing cartridge being removably mounted in the first photosensitive cartridge, the first photosensitive cartridge comprising:

a photosensitive drum on which an electrostatic latent image is formed;

a charger that is provided at a position adjacent to the photosensitive drum and that charges the photosensitive drum;

a first wall which is provided adjacent to the supply roller, a portion of the toner hopper, and a portion of the developing roller of the first developing cartridge when the first developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum, wherein a portion of a wall of the first developing cartridge projects through the first opening in the first wall of the first photosensitive cartridge.

2. The image forming apparatus according to claim 1, further comprising:

a second developing cartridge comprising a toner hopper, a supply roller, and a developing roller;

a second photosensitive cartridge, the second developing cartridge being removably mounted in the second photosensitive cartridge, the second photosensitive cartridge comprising:

a photosensitive drum on which an electrostatic latent image is formed;

a charger that is provided at a position adjacent to the photosensitive drum and that charges the photosensitive drum;

a first wall which is provided adjacent to the supply roller, a portion of the toner hopper, and a portion of the developing roller of the second developing cartridge when the second developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum, wherein the first photosensitive cartridge and the second photosensitive cartridge are arranged in parallel inside the image forming apparatus such that the second opening of the first photosensitive cartridge faces the first opening of the second photosensitive cartridge.

3. The image forming apparatus according to claim 2, further comprising:

a transfer roller that extends substantially parallel to an axial direction of the photosensitive drum of the first photosensitive cartridge and ispositioned adjacent to the photosensitive drum, wherein the first photosensitive cartridge further comprises a cleaning roller, which extends substantially parallel to an axial direction of the photosensitive drum and is provided adjacent to the photosensitive drum to clean the photosensitive drum, and wherein the first photosensitive cartridge and the second photosensitive cartridge are arranged in parallel within the image forming apparatus such that the transfer roller, the cleaning roller of the first photosensitive cartridge, and the supply roller of the second developing cartridge of the second photosensitive cartridge are arranged substantially along a straight line as viewed from the axial direction of the photosensitive drum.

4. The image forming apparatus according to claim 1, wherein the first developing cartridge comprises:

a housing comprising:

a first arc portion forming a side wall of the toner hopper;

a second arc portion forming a side wall of the supply roller and the developing roller; and a concave portion located at a position at which the first arc portion and the second arc portion meet, wherein a portion of the second arc portion projects through the first opening in the first wall of the first photosensitive cartridge.

5. The image forming apparatus according to claim 4, wherein the first developing cartridge further comprises a plurality of triangular ribs which are spaced apart along the concave portion.

6. The image forming apparatus according to claim 4, further comprising:

a second developing cartridge comprising a toner hopper, a supply roller, and a developing roller;

a second photosensitive cartridge, the second developing cartridge being removably mounted in the second photosensitive cartridge, the second photosensitive cartridge comprising:

a photosensitive drum on which an electrostatic latent image is formed;

a charger that is provided at a position adjacent to the photosensitive drum and that charges the photosensitive drum;

a first wall which is provided adjacent to the supply roller, a portion of the toner hopper, and a portion of the developing roller of the second developing cartridge when the second developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum, wherein the first photosensitive cartridge and the second photosensitive cartridge are arranged in parallel inside the image forming apparatus such that the second opening of the first photosensitive cartridge faces the first opening of the second photosensitive cartridge.

7. The image forming apparatus according to claim 6, wherein the second developing cartridge comprises:

a housing comprising:

a first arc portion forming a side wall of the toner hopper;

a second arc portion forming a side wall of the supply roller and the developing roller; and a concave portion located at a position at which the first arc portion and the second arc portion meet, wherein a portion of the first arc portion projects through the first opening in the first wall of the second photosensitive cartridge.

8. The image forming apparatus according to claim 7, further comprising:

a transfer roller that extends substantially parallel to an axial direction of the photosensitive drum of the first photosensitive cartridge and positioned adjacent to the photosensitive drum, wherein the first photosensitive cartridge further comprises a cleaning roller, which extends substantially parallel to an axial direction of the photosensitive drum and is provided adjacent to the photosensitive drum to clean the photosensitive drum, and wherein the first photosensitive cartridge and the second photosensitive cartridge are arranged in parallel within the image forming apparatus such that the transfer roller, the cleaning roller of the first photosensitive cartridge, and the supply roller of the second developing cartridge of the second photosensitive cartridge are arranged substantially along a straight line as viewed from the axial direction of the photosensitive drum.

9. The image forming apparatus according to claim 7, wherein the concave portion of the second developing cartridge of the second photosensitive cartridge is positioned adjacent to the second opening of the second wall of the first photosensitive cartridge.

10. The image forming apparatus according to claim 3, wherein the first photosensitive cartridge further comprises:

an exposure opening that exposes the photosensitive drum to the transfer roller, and wherein the first wall further comprises a rib extending between the first opening and the exposure opening.

11. An image forming apparatus comprising:

a plurality of developing cartridges, each developing cartridge comprising:

a toner hopper;

a supply roller;

a developing roller;

a first arc portion forming a side wall of the toner hopper;

a second arc portion forming a side wall of the supply roller and the developing roller; and a concave portion located at a position at which the first arc portion and the second arc portion meet;

a plurality of photosensitive cartridges, corresponding to the developing cartridges, the developing cartridges being removably mounted in respective ones of the photosensitive cartridges, each of the photosensitive cartridges comprising:

a photosensitive drum on which an electrostatic latent image is formed;

a charger that is provided at a position adjacent to the photosensitive drum and that charges the photosensitive drum;

a cleaning roller, which extends substantially parallel to an axial direction of the photosensitive drum and is provided adjacent to the photosensitive drum to clean the photosensitive drum;

a first wall which is provided adjacent to the supply roller, a portion of the toner hopper, and a portion of the developing roller of the respective developing cartridge when the respective developing cartridge is mounted in the photosensitive cartridge, the first wall comprising a first opening; and a second wall which faces a portion of the first wall and is provided adjacent to the charger, the second wall comprising a second opening on an opposite side of the charger from the photosensitive drum; and a plurality of transfer rollers, corresponding to the photosensitive cartridges, each transfer roller extending substantially parallel to an axial direction of the photosensitive drum of the respective photosensitive cartridge and positioned adjacent to the photosensitive drum, wherein a portion of the second arc portion of each developing cartridge projects through the first opening in the first wall of the corresponding photosensitive cartridge, and wherein the plurality of photosensitive cartridges are arranged in parallel within the image forming apparatus such that the transfer roller and the cleaning roller of one of the photosensitive cartridges and the supply roller of a photosensitive cartridge neighboring the one of the photosensitive cartridges are arranged substantially along a straight line as viewed from an axial direction of the photosensitive drums.

12. A photosensitive cartridge for use with a developing cartridge which is capable of being mounted in the photosensitive cartridge and which comprises a toner hopper, a supply roller, and a developing roller, the photosensitive cartridge comprising:

a photosensitive drum on which an electrostatic latent image is formed;

a charger that is provided in a position adjacent to the photosensitive drum to charge the photosensitive drum;

a first wall which is provided adjacent to the supply roller, a portion of the toner hopper, and a portion of the developing roller of the developing cartridge when the developing cartridge is mounted in the photosensitive cartridge, the first wall comprising an opening; and a second wall which faces a portion of the first wall and is provided adjacent to the charger.

13. The photosensitive cartridge according to claim 12, wherein a position of the opening in the first wall corresponds to a position of the supply roller of the developing cartridge when the developing cartridge is mounted in the photosensitive cartridge.

14. The photosensitive cartridge according to claim 13, wherein a portion of a wall of the developing cartridge that is adjacent to the supply roller projects through the opening in the first wall when the developing cartridge is mounted in the photosensitive cartridge.

15. The photosensitive cartridge according to claim 12, wherein a portion of a wall of the developing cartridge projects through the opening in the first wall when the developing cartridge is mounted in the photosensitive cartridge.

* * * * *